US008210806B2

(12) United States Patent
Yang et al.

(10) Patent No.: US 8,210,806 B2
(45) Date of Patent: Jul. 3, 2012

(54) VENTILATOR

(75) Inventors: Jingtao Yang, Guangdong (CN); Guangzhu Xuan, Guangdong (CN); Zewei Rao, Guangdong (CN)

(73) Assignees: Panasonic Corporation, Osaka (JP); Panasonic Ecology Systems, Guangdong Co., Ltd., Guangdong (CN)

( * ) Notice: Subject to any disclaimer, the term of this patent is extended or adjusted under 35 U.S.C. 154(b) by 817 days.

(21) Appl. No.: 12/280,600

(22) PCT Filed: Feb. 25, 2007

(86) PCT No.: PCT/CN2007/000608

§ 371 (c)(1), (2), (4) Date: Jan. 12, 2009

(87) PCT Pub. No.: WO2007/095861

PCT Pub. Date: Aug. 30, 2007

(65) Prior Publication Data

US 2010/0284803 A1 Nov. 11, 2010

(30) Foreign Application Priority Data

Feb. 23, 2006 (CN) ..... 2006 1 0009468

(51) Int. Cl.
*F04D 29/44* (2006.01)

(52) U.S. Cl. .... 415/204; 415/206; 417/360; 417/423.15

(58) Field of Classification Search ..... 417/360, 417/423.15; 415/204
See application file for complete search history.

(56) References Cited

U.S. PATENT DOCUMENTS

| | | | | |
|---|---|---|---|---|
| 2,936,947 | A * | 5/1960 | Staak | 417/353 |
| 4,200,257 | A * | 4/1980 | Litch, III | 248/604 |
| 5,555,647 | A * | 9/1996 | Torborg et al. | 34/601 |
| 6,203,293 | B1 | 3/2001 | Yamamoto | |

FOREIGN PATENT DOCUMENTS

| | | | |
|---|---|---|---|
| CN | 2718283 | Y | 8/2005 |
| CN | 2748674 | Y | 12/2005 |
| GB | 132754 | A | 9/1973 |
| GB | 2149013 | A | 6/1985 |
| GB | 2281102 | | 2/1995 |
| JP | 57168795 | U | 10/1982 |
| JP | 61268900 | | 11/1986 |

(Continued)

OTHER PUBLICATIONS

International Search Report May 18, 2007.

(Continued)

*Primary Examiner* — Evan Pert
*Assistant Examiner* — Krista Soderholm
(74) *Attorney, Agent, or Firm* — RatnerPrestia

(57) ABSTRACT

A ventilator (100) includes a frame (10), a volute (20) mounted in the frame (10), a motor bracket (60) mounted in the opening of the volute (20) and a motor (30) fitted in the motor bracket (60). The frame (10) is made of metal material. The character of the ventilator is in that the motor bracket (60) is made of metal material. Since the metal motor bracket has favorable performances of heat radiation and rigidity, the ventilator (100) has better security and stability.

15 Claims, 6 Drawing Sheets

FOREIGN PATENT DOCUMENTS

| | | | |
|---|---|---|---|
| JP | 380665 | | 8/1991 |
| JP | 8136027 | A | 5/1996 |
| JP | 8-284896 | A | 10/1996 |
| JP | 10009198 | A | 1/1998 |
| JP | 2000-97194 | A | 4/2000 |
| JP | 2001-178067 | A | 6/2001 |
| JP | 2002021781 | A | 1/2002 |
| JP | 2004073330 | A | 3/2004 |

OTHER PUBLICATIONS

Chinese Office Action.
Japanese Office Action with English Summary dated Feb. 1, 2011 for Japanese Application No. 2008-555600.
Japanese Office Action with English Summary dated Aug. 30, 2011 for Japanese Application No. 2008-555600.

* cited by examiner

VENTILATOR

BACKGROUND OF THE INVENTION

1. Field of the Invention

The present invention mainly relates to a ventilation fan.

2. Description of the Related Art

A ventilation fan is a common ventilating device. Sometimes the ventilation fan is provided onto a frame of a ceiling so as to draw out the indoor air. In that case, the weight of the ventilation fan is usually managed to be reduced in view of the safety weight that can be withstood by the ceiling.

As shown in FIG. 1, a ventilation fan 100 comprises a frame 1, a scroll casing 2 provided in the frame, and a motor 3. The motor 3 is fixed on an opening portion of the scroll casing 2 by means of a motor holder 7 which is formed integrally with the scroll casing 2, and fan blades 5 are mounted on the motor 3. Once the fan blades 5 rotate, a negative pressure is generated in the scroll casing 2 so as to draw in air.

The frame 1 is usually made of metal materials in order to obtain integral sturdiness. The scroll casing 2 and the motor holder 7 are made of resin materials, thus the weight of the ventilation fan 100 may be reduced.

If the motor 3 operates for a long time, a large amount of heat will be generated. Though the above design reduces the weight of the ventilation fan 100, the heat can not be emitted effectively, which results in a rise in temperature of the motor 3. The rise in temperature may deform the motor holder 7 fixing the motor 3 and thus causing the motor 3 to depart from an original mounted position. As a result, the performance of the ventilation fan 100 deteriorates, and more adversely, the fan blades 5 may come into contact with the scroll casing 2 and thus the ventilation fan 100 may be damaged.

However, it is very difficult to provide a heat dispersion structure for the motor 3 alone due to the limitation of an inner space of the ventilation fan 100.

SUMMARY OF THE INVENTION

In view of the above, at least one aspect of the present invention is to provide a ventilation fan in which a motor thereof may emit heat easily and thus safety of the fan is improved.

According to an aspect of the present invention, there is provided a ventilation fan, comprising: a frame; a scroll casing provided in the frame; a motor holder provided in an opening portion of the scroll casing; and a motor mounted on the motor holder, wherein the frame is made of a metal material, and the motor holder is made of a metal material.

Since the motor holder is made of a metal material, the stability thereof to fix the motor is enhanced; in addition, since a housing of the motor is made of a metal material and the motor is fixed directly to the metal motor holder, the heat produced from the motor can be transferred directly from the metal motor holder located in a ventilation path, thus a high thermal endurance is obtained.

Therefore, though the temperature of the motor rises, the metal motor holder, different from a resin motor holder in the art, does not tend to deform, and thus, the fan blades will not contact with the scroll casing while a ventilation performance is maintained.

Further, because of metal intensity, deformation of the metal motor holder is smaller than that of the resin motor holder. Therefore, the ventilation resistance of the present ventilation fan can be reduced.

Alternatively, the motor holder includes a first metal holder and a second metal holder fitted together, and the motor is fixed between the first metal holder and the second metal holder. The stability of the motor is enhanced since it is held by two metal holders.

Alternatively, the first metal holder is fixed on an inner wall of the scroll casing, and the second metal holder is fixed on an extended portion of the scroll casing opened to a central portion thereof.

Alternatively, the first metal holder and the second metal holder are both fixed on an inner wall of the scroll casing.

Alternatively, the first metal holder, the second metal holder and the scroll casing are connected by means of screws.

Alternatively, between the motor holder and the frame is connected a metal connection strap. The ventilation fan incorporating the metal connection strap brings about the following advantages: (1) a part of the weight supported by the motor holder may be transferred to the frame by the metal connection strap, thus the motor holder is doubly secured by the metal connection strap and the motor will not fall off in the case that the motor is on fire; (2) grounding continuity of the frame is improved; (3) a grounding conductivity of metal components, such as the motor, is also enhanced by the metal connection strap, thus the safety is improved.

Alternatively, the metal connection strap is located outside the scroll casing. The above design will facilitate installation.

Alternatively, the metal connection strap is located inside the scroll casing. This design will help to cool the motor by cooling air since air passes through the metal connection strap when the fan blades rotate.

As indicated above, the thermal diffusivity and the safety of the ventilation according to the present invention are improved.

DETAILED DESCRIPTION OF THE EMBODIMENTS

Figure 2A:
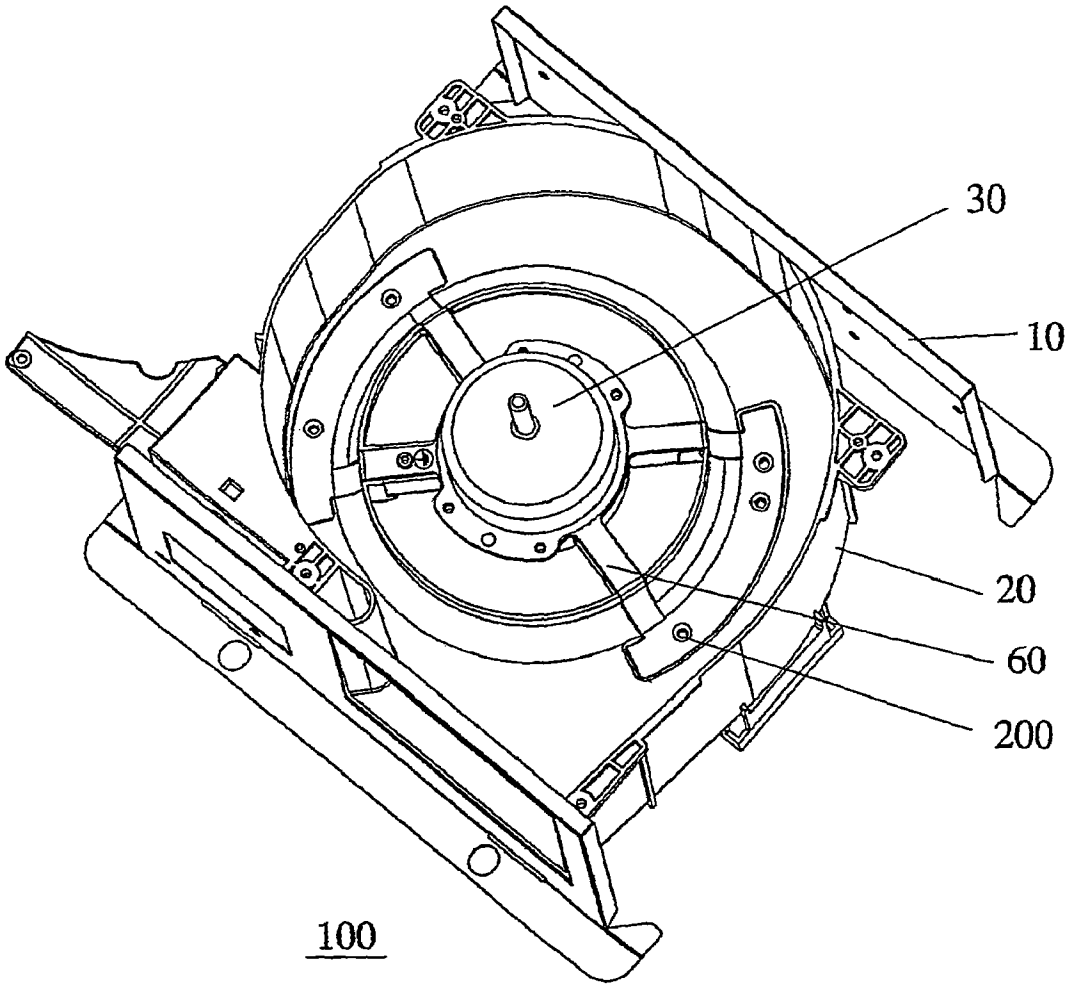
FIGS. 2A and 2B are schematic views of a ventilation fan according to a first embodiment of the present invention.
Figure 2B:
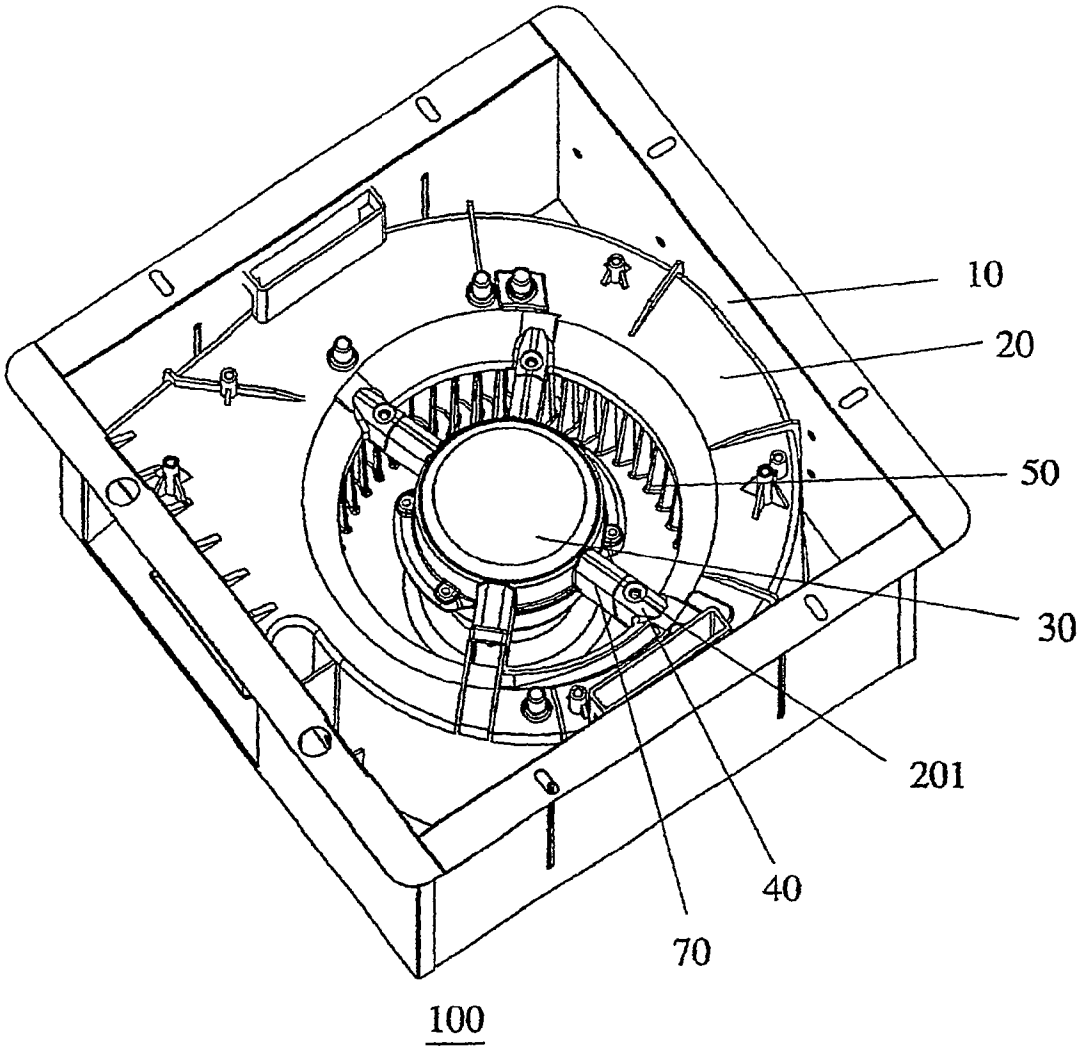

FIGS. 2A and 2B are schematic views of a ventilation fan 100 according to a first embodiment of the present invention. In the FIG. 2A, fan blades are removed for the purpose of clarity. The ventilation fan 100 comprises a frame 10, a scroll casing 20 and a motor 30. The motor 30 is fixed on an opening portion in the scroll casing 20 by means of a metal motor holder. Fan blades 50 are mounted on the motor 30. As shown in the figures, the metal motor holder includes a first metal holder 60 and a second metal holder 70 which are fitted together.

Figure 1:
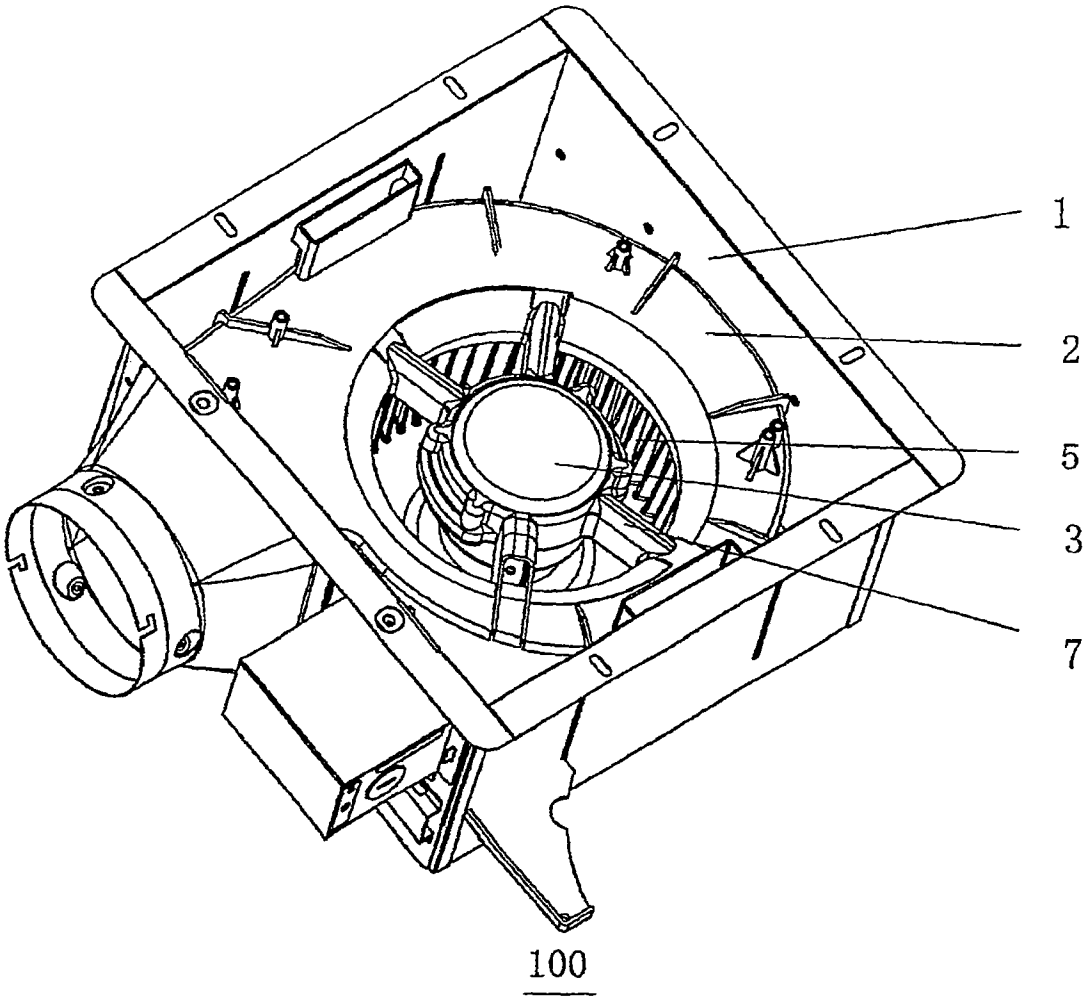
FIG. 1 is a schematic view of a ventilation fan in the prior art.

Compared with the prior arts in FIG. 1, the above motor holder is made of metal instead of resin. The first metal holder 60 and the second metal holder 70 cooperate to clamp and secure the motor 30. One end of the first metal holder 60 is fixed on a housing of the motor 30, and the other end of the first metal holder 60 is formed into a flake fixed on an inner wall of the scroll casing 20. One end of the second metal holder 70 is fixed on the housing of the motor 30, and the other end of the second metal holder 70 is fixed on an extended portion 40 of the scroll casing 20 opened to a central portion thereof. In this way, the stability of the motor 30 and the thermal diffusivity of the motor holders are enhanced as much as possible. Also as shown in the figures, the first and second metal holders 60 and 70 are fixed on the extended portion 40 by means of screws 201, and at the same time, the first metal holder 60 and the scroll casing 20 are secured by means of screws 200.

Alternatively, an integral metal holder can replace the first and second metal holders in the first embodiment. The motor holder is fixed on the scroll casing made of a resin material, and the motor is fixed on the motor holder.

Figure 3A:
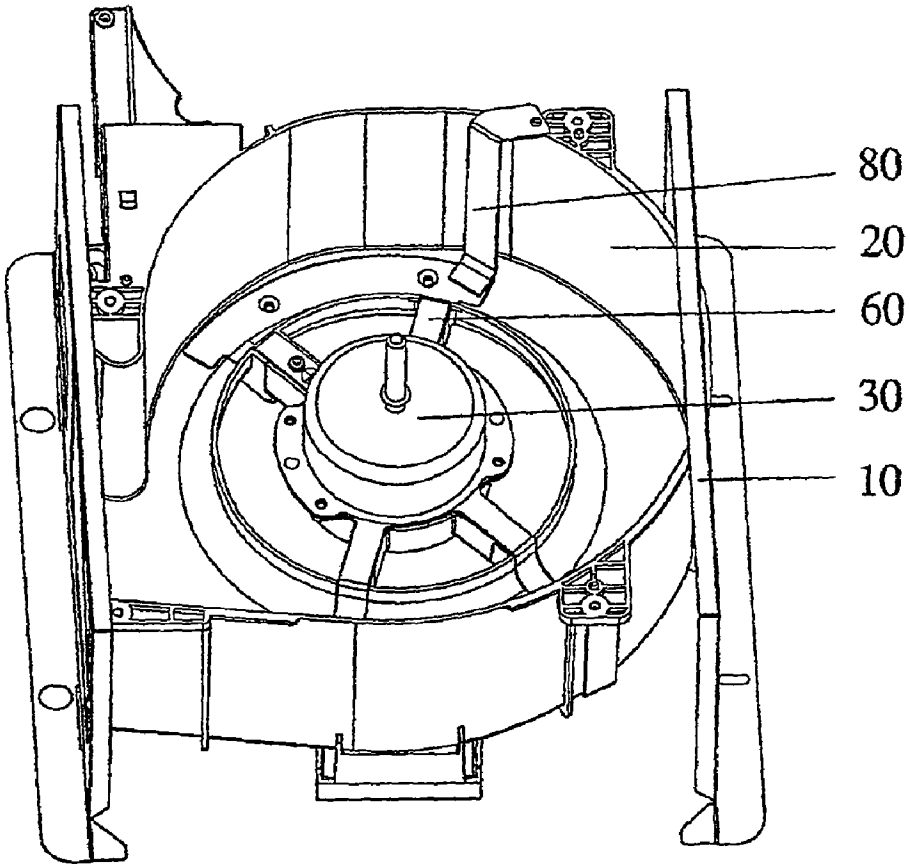
FIGS. 3A and 3B are schematic views of a ventilation fan according to a second embodiment of the present invention.
Figure 3B:
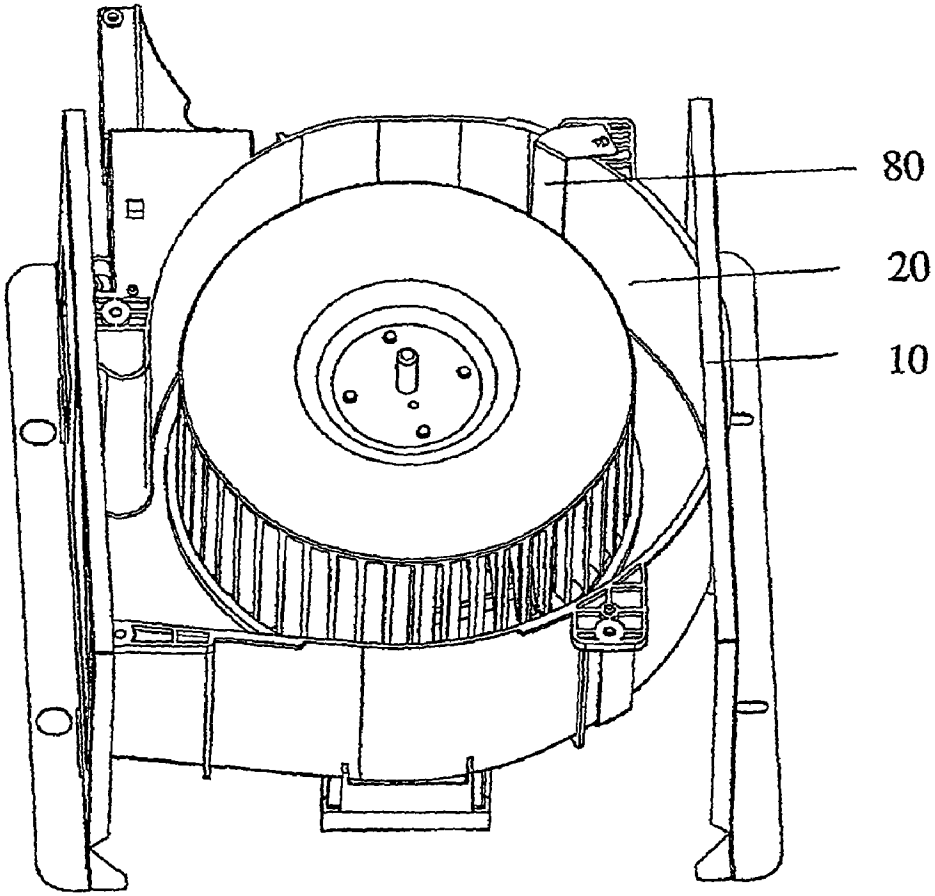

FIGS. 3A and 3B are schematic views of a ventilation fan according to a second embodiment of the present invention. In FIG. 3A, the fan blades and an upper layer of the frame are removed, and in FIG. 3B, the upper layer of the frame is removed, for the purpose of clarity. Based on the first embodiment, a metal connection strap 80 is connected between the motor holder and the frame 10, and the metal connection strap 80 is located inside of the scroll casing 20.

The metal connection strap 80 has two bends, so that one end of the metal connection strap 80 is bent to fixedly connect the first metal holder 60 of the motor holder, and the other end of the metal connection strap 80 is bent to fixedly connect the frame 10, both in a form of surface contact. The heat generated by the motor 30 can be transferred rapidly to the frame 10 made of a metal material via heat conduction of the metal connection strap 80, therefore, the heat dispersion is accelerated.

In the present invention, the metal connection strap 80 is located inside of the scroll casing 20, thus, the metal connection strap 80 may be cooled down effectively by means of a cooling action of the air flowing inside the scroll casing 20.

Further, the housing of the motor 30 and the frame 10 connected together are conductive, thus, a ground line (not shown) may be connected to the frame 10 instead of being connected to the motor 30, in this regard, the mounting of the ground line is simplified.

Figure 4:
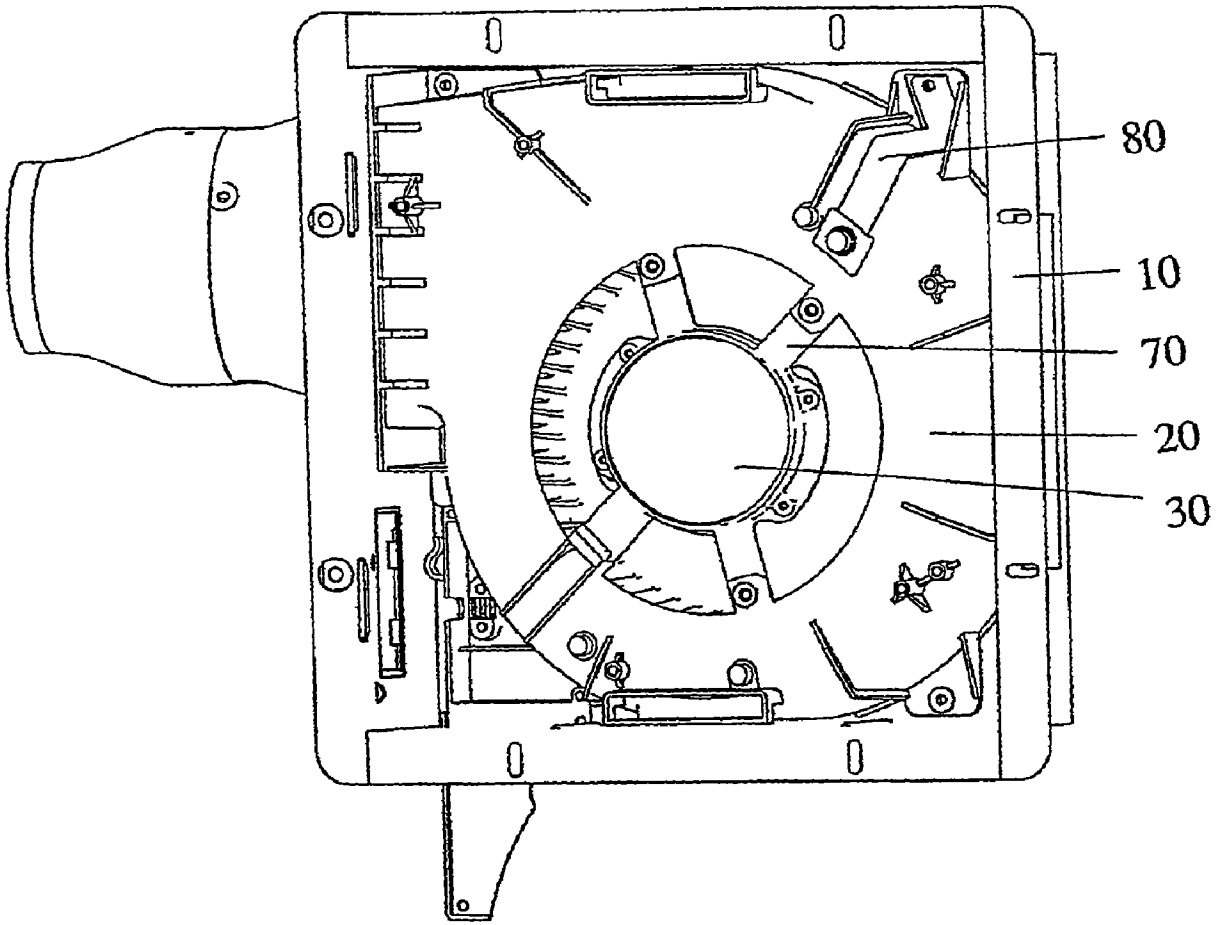
FIG. 4 is a schematic view of a ventilation fan according to a third embodiment of the present invention.

FIG. 4 is a schematic view of a ventilation fan according to a third embodiment of the present invention. Based on the first embodiment, a metal connection strap 80 is connected between the motor holder and the frame 10, and the metal connection strap 80 is located outside of the scroll casing 20.

The metal connection strap 80 has two bends, so that one end of the metal connection strap 80 is bent to fixedly connect the first metal holder (not shown) of the motor holder, and the other end of the metal connection strap 80 is bent to fixedly connect the frame 10, both in a form of surface contact. The heat generated by the motor 30 can be transferred rapidly to the frame 10 made of a metal material via heat conduction of the metal connection strap 80, therefore, the heat dispersion is accelerated.

What is claimed is:

1. A ventilation fan comprising:

a frame;

a scroll casing provided in the frame;

a motor holder provided in an opening portion of the scroll casing; and a motor mounted on the motor holder, wherein the frame is made of a metal material and the motor holder is made of a metal material, and wherein one end of the motor holder is fixed on a housing of the motor, and the other end of the motor holder is fixed on an inner wall of the scroll casing.

2. The ventilation fan as claimed in claim 1, wherein the motor holder includes a first metal holder and a second metal holder fitted together, and the motor is fixed between the first metal holder and the second metal holder.

3. The ventilation fan as claimed in claim 2, wherein one end of the first metal holder is fixed on the housing of the motor, and the other end of the first metal holder is formed into a flake fixed on the inner wall of the scroll casing, and one end of the second metal holder is fixed on the housing of the motor, and the other end of the second metal holder is fixed on an extended portion of the scroll casing opened to a central portion thereof.

4. The ventilation fan as claimed in claim 2, wherein the first metal holder and the second metal holder are both fixed on the inner wall of the scroll casing.

5. The ventilation fan as claimed in claim 2, wherein the first metal holder, the second metal holder and the scroll casing are connected by means of screws.

6. The ventilation fan as claimed in claim 1, wherein between the motor holder and the frame is connected a metal connection strap.

7. The ventilation fan as claimed in claim 6, wherein the metal connection strap is located inside the scroll casing.

8. The ventilation fan as claimed in claim 6, wherein the metal connection strap is located outside the scroll casing.

9. The ventilation fan as claimed in claim 3, wherein the first metal holder, the second metal holder and the scroll casing are connected by means of screws.

10. The ventilation fan as claimed in claim 2, wherein between the motor holder and the frame is connected a metal connection strap.

11. The ventilation fan as claimed in claim 3, wherein between the motor holder and the frame is connected a metal connection strap.

12. The ventilation fan as claimed in claim 10, wherein the metal connection strap is located inside the scroll casing.

13. The ventilation fan as claimed in claim 11, wherein the metal connection strap is located inside the scroll casing.

14. The ventilation fan as claimed in claim 10, wherein the metal connection strap is located outside the scroll casing.

15. The ventilation fan as claimed in claim 11, wherein the metal connection strap is located outside the scroll casing.

* * * * *